US005553556A

United States Patent [19]

Krüger

[11] Patent Number: 5,553,556

[45] Date of Patent: Sep. 10, 1996

[54] METHOD FOR BURNING SOLID MATTER

[75] Inventor: Jörg Krüger, Schwandorf, Germany

[73] Assignee: Mullkraftwerk Schwandorf Betriebsgesellschaft mbH, Schwandorf, Germany

[21] Appl. No.: 211,727

[22] PCT Filed: Oct. 2, 1992

[86] PCT No.: PCT/EP92/02280

§ 371 Date: Aug. 15, 1994

§ 102(e) Date: Aug. 15, 1994

[87] PCT Pub. No.: WO93/07422

PCT Pub. Date: Apr. 15, 1993

[30] Foreign Application Priority Data

Oct. 8, 1991 [DE] Germany ..... 41 33 239.3

[51] Int. Cl.[6] ..... F23J 11/00; F23J 15/00

[52] U.S. Cl. ..... 110/345; 110/348; 110/211; 110/215; 110/235

[58] Field of Search ..... 110/345, 346, 110/297, 306, 215, 234, 348, 235

[56] References Cited

U.S. PATENT DOCUMENTS 3,473,331 10/1969 Fernandes .

4,285,282 8/1981 Good .

FOREIGN PATENT DOCUMENTS

| | | |
|---|---|---|
| 1062199 | 9/1979 | Canada . |
| 0487052A2 | 5/1992 | European Pat. Off. . |
| 2615369B2 | 1/1977 | Germany . |
| 3125429A1 | 2/1983 | Germany . |
| 3915992A1 | 11/1989 | Germany . |
| 428063 | 7/1967 | Switzerland . |

*Primary Examiner*—Henry A. Bennett
*Assistant Examiner*—Susanne C. Tinker
*Attorney, Agent, or Firm*—Darby & Darby, P.C.

[57] ABSTRACT

A process for incinerating solids, especially for burning rubbish in a combustion vessel comprising at least one combustion chamber and an after-burner chamber. Here, instead of secondary or tertiary air, water vapor under increased pressure is sprayed into the combustion vessel after the combustion gases have left the combustion chamber. Only primary air is supplied as the combustion air. In this manner and with the use of minimum quantities of combustion air, it is possible to increase the effectiveness of the overall process while at the same time reducing the emission of pollutants. It is also possible to feed back flue gas together with the water vapor, so that, for example, the maximum temperatures, the temperature reduction and the dwell times in the 1st and 2nd flue of the vessel can be easily set to the optima.

16 Claims, 1 Drawing Sheet

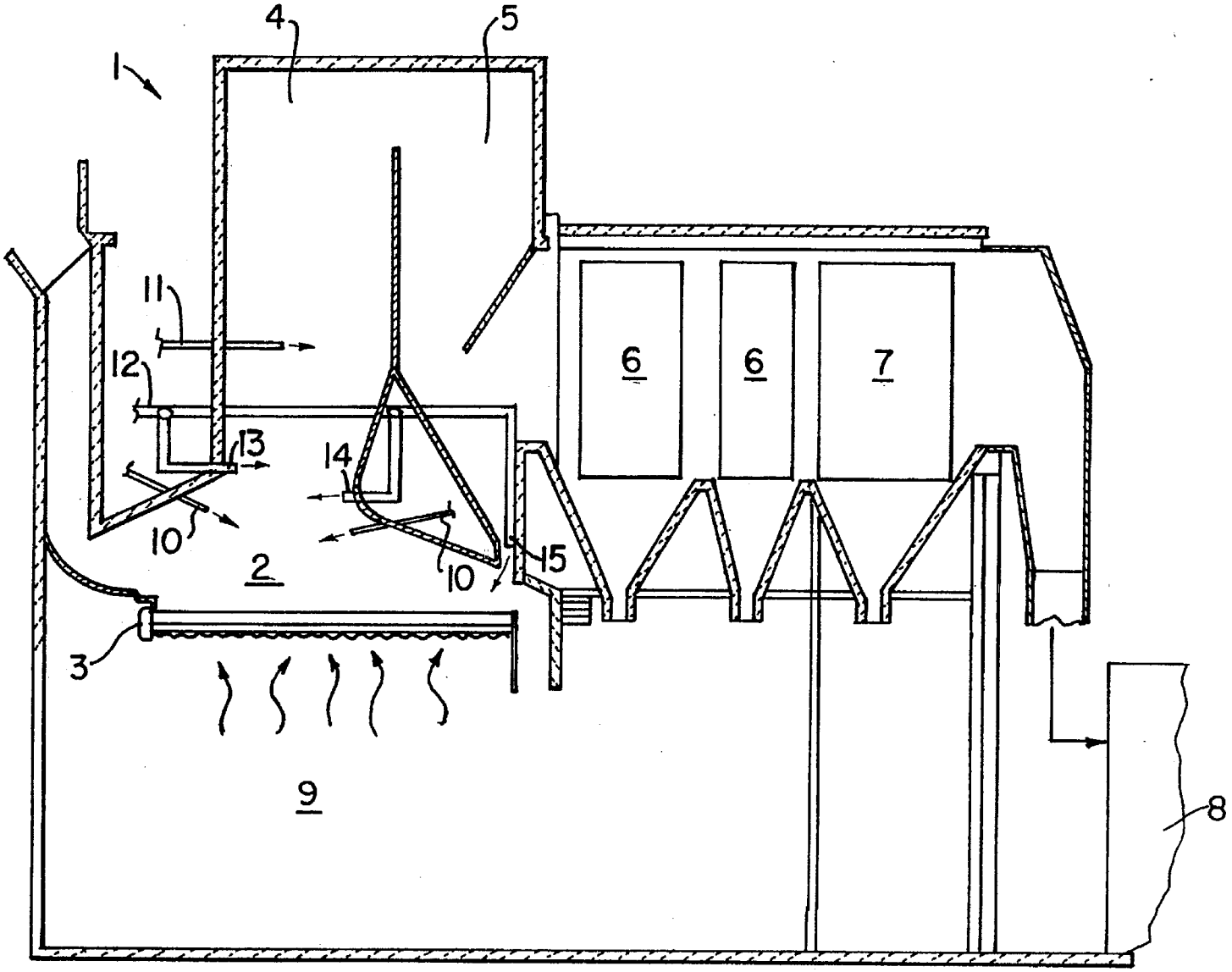
1
2
3
4
5
6
6
7
8
9
10
10
11
12
13
14
15

METHOD FOR BURNING SOLID MATTER

The present invention relates to a method for burning solid matter, particularly for incinerating garbage, in a combustion boiler, which comprises at least one combustion chamber and at least one afterburner chamber, steam being introduced into the combustion boiler.

Pollutant-containing waste gases are formed during the incineration of solid energy carriers, such as garbage or coal. For ecological and economic reasons, the combustion should be carried out with an optimum excess of air, in order to minimize the amounts of waste gases and pollutants. However, for process and equipment reasons, the ecological and economically optimum modes of operation frequently are in contradiction with one another.

Adequate combustion of the flue gases with the oxygen of the air is assured only if there is an excess of air and corresponding turbulence in or directly above the combustion chamber. To produce these turbulences, a portion of the combustion air is usually blown in as secondary air with a slight pressure and moderate velocity. The formation of carbon monoxide and nitrogen oxides is to be decreased in this way. The amount of secondary air blown in must be sufficiently large in order to ensure, at the same time, the necessary turbulence and, with that, adequate mixing. However, due to this excess air, the amount of waste gas and, with that, the loss of usable energy increase noticeably.

The adiabatic combustion temperatures fall appreciably as the excess of air increases. For example, at a high excess of air, additional formation of carbon monoxide can be caused by overcooling the combustion gases due to the addition of the secondary air. In the boundary region of the secondary air flow, however, high temperature peaks can occur which, in conjunction with the locally high oxygen concentrations, contribute to the formation of $NO_x$.

During the incineration of garbage, the oxygen concentration in the moist flue gas after the combustion boiler usually is about 10% by volume. In this case, the excess of air is about 150%, corresponding to an air ratio of 2.5. Between 10% and 40% of the combustion air is usually blown in as secondary air. A reduction in the secondary air leads to less complete combustion of the combustion gases, while a reduction in the primary air leads to less complete combustion of the slag.

It is a further objective of the secondary air to achieve a certain flame guidance. By these means, the ascending convection current in the first flue of the combustion boiler (afterburner chamber) is to be broken and, with that, a narrow residence-time spectrum is to be produced in the first flue. At best, this objective has previously been attained incompletely. Because of the additional amount of air, the use of tertiary air for breaking the ascending convection current has also only been of limited usefulness since, for instance, additional carbon monoxide is formed and further amounts of flue gas result from the cooling.

It is a significant disadvantage of previous methods that, for reliably combusting the waste gases completely and for breaking the ascending convection current, large amounts of secondary or tertiary air are required. The addition of these large amounts of air is possible only if, at the same time, the amount of primary air is reduced, in which case, however, the completeness of the combustion on the grate is endangered. Increasing the amount of flue gas moreover leads to a shorter, average residence time in the first flue. An optimum breakdown of pollutant is therefore not ensured. Moreover, the adiabatic combustion temperature is lowered by the increased amount of air. The temperature reduction in the region of the steam generator therefore proceeds correspondingly flat. As a result, the heat utilization is decreased appreciably.

It is an object of the present invention to develop a method for incinerating solid matter, with which it is possible to decrease the amounts of pollutants in the flue gas. At the same time, either the amount of flue gas is to be decreased appreciably while the heat output remains the same, or vice versa the fuel throughput is to be increased appreciably. The method shall be carried out with the least possible excess of air. At the same time, the disadvantages of the known methods are to be largely avoided. In particular, the method is to be suitable for use in garbage power plants.

The solid matter, such as garbage or coal, is charged into a combustion boiler and burned on a grate in the combustion chamber. The primary combustion air is blown in through the grate from below. The hot flue gases formed in the combustion chamber initially flow through an afterburner chamber (first flue of the boiler) and are then passed over further radiation flues to the convection part of the boiler. Subsequently, the flue gas is freed from dust and pollutants in a flue gas purification plant and discharged to the atmosphere through a chimney.

Pursuant to the inventive method, aside from the primary air, no other combustion air, such as secondary or tertiary air, is introduced into the combustion boiler. The exclusive use of primary air would, however, lead to incomplete combustion of the flue gas due to insufficient mixing in the afterburner chamber (post-reaction or complete combustion chamber), and to correspondingly to high carbon monoxide and pollutant contents in the waste gas. Pursuant to the invention therefore, steam is injected under pressure into the combustion boiler at at least one place after the combustion gases emerge from the combustion chamber. Due to the injection of steam, the formation of carbon monoxide and nitrogen oxide in the flue gas is not promoted. By means of the steam, mixing energy is provided, which is required for producing turbulences necessary for optimum combustion conditions of the burnable gases. In this way, the total amount of air and the oxygen content of the flue gas can be reduced considerably. A decrease in the amount of flue gas for the same net heat output and the need for less fuel or an increase in the heat output by increasing the fuel throughput while keeping the amount of flue gas constant are important advantages of this procedure.

The adjusted overpressure and the volume flow of the steam determine the mixing energy, which is brought pursuant to the invention by the steam into the combustion boiler. A value of at least one bar should be selected for the minimum overpressure of the steam. Below this value, the volume flow of the steam must be set at a very high value in order to ensure adequate mixing energy. The amount of flue gas can then, at best, be decreased slightly. Moreover, undesirably high water contents could arise in the flue gas. In principle therefore, the highest possible overpressure of steam should be provided. The upper limit is determined only by the justifiable expense for equipment.

The volume flow of steam is adjusted depending on the overpressure, a lesser volume flow being required at higher pressures and vice-versa. At the specified pressure of steam, the volume flow preferably is selected so that a mixing energy ranging from 0.1 to 30 kW per $m^3$ of turbulence space is introduced.

The turbulence space is that region in the combustion boiler, which is covered directly by the steam injected. The volume $V_T$ of the turbulence space can be calculated, for example, by the following formula:

$$V_T=(\pi/4\times d_{hydr.}^2)\times(a\times d_{hydr.})$$

wherein a can assume values between 0.2 and 0.5. As the number of nozzle planes for the steam increases, smaller values of said region are to be specified for a. The characteristic length $d_{hydr.}$ (hydraulic diameter) is calculated from the following equation:

$$d_{hydr.}=4F/U$$

wherein F is the cross section through which the combustion gases flow (for example, the smallest cross section after leaving the combustion chamber) and U refers to its circumference.

The amount of mixing energy to be introduced can be related to the volume of waste gas. In this case, mixing energies advantageously are adjusted to values between 0.03 and 3 W per $Nm^3/h$ of waste gas.

Below a mixing energy of 0.1 $kW/m^3$ of turbulence space or 0.03 W per $Nm^3/h$ of exhaust gas, the turbulences produced are not sufficient for ensuring optimum combustion conditions, while at mixing energies above 30 $kW/m^3$ of turbulence space or 3 W per $Nm^3/h$ of exhaust gas, uneconomically high pressures and/or volume flows of the steam become necessary. A narrow residence time spectrum within the afterburner (post-reaction chamber or complete combustion chamber) of the combustion boiler is attained when the pressure and the volume flow of the steam are selected so that a uniform piston flow of the flue gas is achieved in the afterburner chamber. An optimum thermal degradation of pollutants can be guaranteed in this way.

Comparatively high temperatures in the afterburner chamber can be achieved with the inventive method, since the flue gases are not cooled here by large amounts of excess air. The temperature upon entering the afterburner chamber preferably should be within the range of 1273° to 1673° K, in order to ensure adequate combustion of the pollutants. Above 1673° K, the danger exists of increased formation of $NO_x$, even at lower oxygen content in the flue gas. Moreover, by controlling the injection parameters of the steam, the average residence time of the flue gases in the afterburner chamber at temperatures not less than 1123° K can be increased to such an extent, that the breaking down of pollutants is increased appreciably.

The drawing shows diagrammatically an incinerator plant which can be used for combusting solid matter in accordance with the invention.

An incinerator plant for solid matter, conventional according to the previous state of the art, is shown diagrammatically in FIG. 1. In the lower region of the combustion boiler 1, the grate 3 is disposed, on which the solid matter, such as garbage or coal, is to be combusted with addition of primary air 9. Directly above the grate 3, there is the combustion chamber 2, the top of which goes over into the afterburner chamber 4, corresponding to the first flue of the boiler. The hot flue gases, formed during the combustion in the combustion chamber 2, initially flow through the afterburner chamber 4. They are then passed over the second flue 5 of the boiler 1 to the evaporators and super-heaters 6 and the ECO 7. Subsequently, dust and pollutants are removed in a flue gas purification plant 8. If secondary air is employed for such a combustion plant, it is supplied over the secondary air nozzles 10, which are disposed in the combustion chamber 2 in the region of the transition to the afterburner chamber 4. Optionally, additional tertiary air can be injected over tertiary air nozzles 11, which are installed in the afterburner chamber 4.

Pursuant to the inventive method, exclusively primary air is used as combustion air. Secondary and tertiary air are replaced completely by steam. For this, the steam is injected at a volume flow, which is far below the usually employed secondary and tertiary air volume flows. In order nevertheless to introduce sufficiently high mixing energy into the boiler 1, the steam is introduced with an excess pressure, which is clearly above the usual pressure of the secondary and tertiary air (about 40 mbar). In this way, it is possible to introduce high mixing energies into the boiler, without having to accept the disadvantages of a large excess of air. Since the combustion temperature increases and the waste gas losses decrease under the inventive conditions, the amount of fuel as well as the amount of primary air can be decreased for the same steam output if the secondary air and primary air are replaced completely. The amount of primary air and the amount of fuel can thus be reduced by 10%. Preferably, the amount of primary air is reduced to such an extent, that the excess of air lies between the value of 150%, previously customary for such combustion plants, and a lower limiting value of 20%. If the air excess is 20%, the oxygen content of the flue gas is about 2%. At lower oxygen contents, the pollutants of the flue gases have a strongly corrosive effect on the boiler walls.

The steam can be injected through nozzles of any construction. Preferably, nozzles designed for ultrasonic operation are employed since particularly good conversion of pressure energy into kinetic energy becomes possible by these means.

In principle, the nozzles can be installed at any suitable places in the boiler wall, preferably in the region where the combustion gases leave the combustion chamber 2 and/or directly in the region of the afterburner chamber 4. Preferably, the nozzles are disposed in one or more nozzle planes. Existing installations can easily be retooled for the inventive method by directly installing the nozzles for the steam instead of the already present secondary and/or tertiary air nozzles.

By injecting the steam in the region where the combustion gases leave the combustion chamber 2, especially the combustion and mixing conditions in the combustion chamber 2, as well as in the inlet for the afterburner chamber 4, are optimized. If additionally or alternatively steam is injected directly into the after burner chamber 4, the development of a uniform piston flow is favored in this region by the disintegrating and swirling of, for example, flue gas strands. In this way, it is possible to produce a uniformly narrow residence time spectrum in the afterburner chamber 4 and to bring the combustion of the pollutants clearly closer to completion.

In particular, the formation of carbon monoxide and $NO_x$ in the flue gas is not promoted by the use of steam pursuant to the inventive method. At the same time, steam is produced in the steam generator 6, 7 of the combustion plant and is therefore available inexpensively and in sufficient amounts. There are, moreover, a series of further advantages. The radiation properties of the flue gas are improved by the higher partial pressure of the water vapor. With that, the heat transfer by radiation and, with that, the heat utilization in the radiation part of the boiler are increased appreciably. In connection with the higher flue gas temperatures and higher carbon dioxide partial pressures achieved under the inventive conditions, the increase in heat transfer due to radiation is disproportionately high. For example, when the temperature is increased from 1073° to 1273° K, the heat transfer increases to twice the value, and when the temperature is increased to 1473° K to 3.5 times the value. Due to the higher heat utilization achieved therewith and the more rapid temperature decrease, the temperature of the waste gas after the steam generator 6, 7 is lowered below the customary values.

Surprisingly, it has furthermore turned out that, when steam is used pursuant to the invention, the dust content of the waste gas can be deposited with exceptionally high efficiency in the electrical flue-gas purification system, presumably due to the higher partial pressure of the water vapor. The dust concentration in the waste gas after the electrostatic filter can be lowered by these means to about 10 mg/Nm$^3$.

Theoretically, instead of steam, gases or gas mixtures can also be used, which likewise have a composition that does not promote the formation of carbon monoxide and $NO_x$ in the flue gas, such as recycled flue gas or also nitrogen or other inert gases or their mixtures. However, these gases are usually present at atmospheric pressure or at only a slightly higher pressure, so that an exceptionally high expenditure for equipment would be necessary for adjusting the pressures to the high values required for the inventive method. When such media are injected with the usual overpressures of 40 mbar, the amount that has to be supplied is so high that the advantages of the inventive method cannot be achieved.

The recycling of flue gases into the combustion region of the boiler for reducing the formation of nitrogen oxides basically is known. Since the flue gas is cold when recycled here, it cannot be excluded that, within the combustion gas stream, local strands of lower temperature are formed, which result in the additional formation of carbon monoxide. Under the special conditions of the inventive method, however, it is possible to recycle also hot flue gas with temperatures above 873° K together with the steam into the combustion boiler. Local excessive cooling with corresponding formation of carbon monoxide can be avoided completely in this way.

The hot flue gas can be recycled from the second flue to the first flue of the boiler, for example, over one or several connecting ducts. In this connection, the steam jets preferably are disposed concentrically in the .connecting ducts for the recycled flue gas. Due to the injector action of the steam injected under high pressure, a portion of the hot flue gases is aspirated out of the second flue of the boiler and, without expensive measures, injected together with the steam into the combustion boiler. Since the pressure relationships, which must be overcome for this recycling of the flue gas, are very slight, only a correspondingly small amount of steam is required for this purpose. If the total amount of steam is introduced into the boiler through several nozzles or nozzle planes, it is sufficient to use only a portion of these nozzles for recycling the flue gas. The proportion of recycled flue gas is adjusted to values of 5 to 50% and preferably of about 30% of the total amount of flue gas. The maximum temperatures, the temperature decline and the residence times in the first and second flues of the boiler can be adjusted in a simple manner therewith to optimum values.

In the same way, nitrogen or other inert gases or their mixtures, together with the steam under high pressure, can be injected by the inventive method into the combustion boiler.

The significant advantages of the inventive method can be summarized as follows:

The amount of flue gas, for the same net heat output, is reduced appreciably if the secondary air and the tertiary air are replaced completely and the primary air is decreased (corresponding to the lower fuel throughput) by 20 to 40%.

While keeping the amount of flue gas constant, the fuel throughput can be increased by up to about 40% without the need for special measures in the flue gas path, particularly in the flue gas purification plant.

The heat utilization is increased by about 15%.

The dust contamination of the heating surfaces in the whole of the boiler as well as the load on the fuel gas purification system decrease at least in proportion to the decreased amount of flue gas, as a result of which the service lives between cleaning cycles can be lengthened.

The combustion temperatures at the inlet of the afterburner chamber are increased significantly and can be controlled by the amount of primary air supplied, as a result of which a more complete combustion is ensured.

The amounts and concentrations of pollutants in the waste gas, particularly carbon monoxide and $NO_x$, are reduced significantly.

Disproportionately high amounts of dust are deposited in the electric gas purification system due to the use of steam.

Due to the use of steam, the heat transfer due to radiation is increased clearly, a more rapid temperature decrease in the boiler installation as well as a lower exhaust gas temperature being achieved.

The driving power required for the air fans and the suction flue can be reduced proportionately to the decreased amount of air.

Downstream gas purification installations can be proportionately smaller.

For downstream "low dust" denitrification plants, the energy expended for reheating the flue gas at the same concentration decreases corresponding to the lower amount of flue gas.

Existing plants can be adapted easily to the inventive method.

In the following, the inventive method is described in greater detail by means of some embodiments.

Injecting Steam

In this example, an existing combustion plant of a garbage power plant was retooled for injecting steam. The steam nozzles were designed for ultrasonic operation. The supply of primary air and steam was set up in each case to be infinitely variable.

During an investigation of the combustion in the garbage power plant, it turned out that the addition of secondary air for the combustion not only was unnecessary but also, if anything, was disadvantageous for the process as a whole. Normally, the plant was operated with a total amount of air of about 80,000 Nm$^3$/h, the secondary air portion being 27,000 Nm$^3$/h. The air excess is approximately 150%, corresponding to an air ratio of 2.5. The oxygen content of the flue gas under these conditions is about 10% by volume. The secondary air is supplied under a slight overpressure of about 40 mbar. When the excess pressure on the secondary air is relieved, a mixing energy of about 30 kW is set free.

In the plant retooled for the inventive method, an amount of steam of about 2,000 kg/h with an overpressure of 5 bar was injected into the combustion boiler in the region of the outlet of the combustion gases from the combustion chamber. While retaining the nominal load of the steam generation, the total amount of air was decreased by about 30%, the secondary air being replaced completely by steam and the amount of primary air being decreased in addition.

Under these inventive conditions, the oxygen content of the flue gas dropped to about 6% by volume (moist). With a comparable fuel, the air ratio was decreased by these means from 2.5 to 18. The amount of flue gas decreased from 100,000 $Nm^3/h$ and was reduced overall by about 27%. The $NO_x$ content of the flue gas was reduced by 25%. At the same time, the carbon monoxide content of the flue gas dropped from values of 20 $mg/Nm^3$ to values of less than 10 $mg/Nm^3$.

The waste gas temperature after the steam generators was reduced from about 500° K to about 470° K. By these means, the chloride deposition in the flue gas purification was increased and the HCl emission was lowered from values of 50 to 80 $mg/Nm^3$ to values below 30 mg/Nm3.

Because of the higher partial pressure of the water pressure, the dust, carried along in the flue gas, and the calcium hydrate, used for the dry flue gas purification, as well as the corresponding reaction products can be deposited in an outstanding manner in the flue gas purification system. This behavior is favored by the lower flue gas temperatures. Moreover, dust emission is affected positively by the clearly lower gas velocities in the electric flue gas purification plant. By these means, the dust content in the flue gas after the electrostatic filter was reduced from values of 40 to 60 $mg/Nm^3$ to values of about 10 $mg/Nm^3$.

The combustion temperature at the inlet to the afterburner was increased by about 200° K. However, the flue gas temperature at the end of the afterburner increased only slightly by 30° to 50° K.

The waste gas losses for comparable service lives between cleaning cycles, at 5.4 MW, are considerably lower than before the retooling, when they were 9.3 MW. While retaining the nominal load of the steam generation, the fuel throughput, which is equivalent to the garbage throughput, could be lowered by more than 10%.

Injecting Steam With Recycling of Hot Flue Gases

For this purpose, investigations were carried out in the same plant and under essentially the same conditions described above.

Over one or several connecting ducts from the second flue to the first flue of the boiler, hot flue gas having a temperature of about 900° K, together with a portion of the steam, was recycled into the first flue of the boiler. A portion of the nozzles for the steam were installed concentrically in the individual flue gas recycling ducts.

Due to the suction action of the steam injected under a pressure of about 6 bar, a portion of the flue gases was drawn off from the second flue (convective portion) and injected into the first flue of the boiler. The recycled flue gas amounted to 30% of the total amount of flue gas. The pressure ratios to be overcome, with values of at most 1 to 5 mbar, were very slight, so that only little steam was required for recycling the flue gases. It was noted in the experiments that between 4 and 40 g of steam are required per $Nm^3$ of recycled flue gas. When slightly superheated steam was used under a pressure of 6 bar and a temperature of about 440° K, the temperature of the recycled flue gas (about 900° K) practically did not decrease.

Under these conditions, it was possible to lower the temperature in the hot zone from about 1473° K (without any recycling of flue gas) to about 1308° K. In this way, it was possible to lower the temperature in the transition to the first flue while retaining a minimum amount of combustion air. The temperature reduction in the first and second flues was somewhat flatter in this case, while the temperature reduction and heat reduction in the convective part of the boiler practically coincided with the corresponding values without recycling of the flue gas. Under these conditions also, a minimum residence time of 2 seconds could be maintained without problems at temperatures above 1123° K. Moreover, the further advantages, described when using steam without recycling flue gas, are maintained.

I claim:

1. A method for combusting solid matter in a combustion boiler, which comprises at least one combustion chamber and at least one afterburner chamber, the method comprising the steps of introducing steam by injection under an elevated pressure into the combustion boiler where the combustion gases leave the combustion chamber, to create turbulence adequate to thoroughly mix the combustion gasses, so that aside from the primary, no further combustion air enters into the combustion boiler.

2. The method of claim 1, wherein the steam is injected with an overpressure of at least 1 bar.

3. The method of claim 1, wherein the pressure and volume flow of the injected steam are adjusted so that a mixing energy ranging from 0.1 to 30 kW per $m^3$ of turbulence space is introduced.

4. The method of claim 1, wherein the pressure and volume flow of the injected steam are adjusted so that a mixing energy ranging from 0.03 to 3 W per $Nm^3/h$ of waste gas is introduced.

5. The method of claim 1, wherein the temperature in the region where the combustion gases enter the afterburner chamber is adjusted to a value between 1273° and 1673° K.

6. The method of claim 1, wherein the volume flow of the primary combustion air is adjusted so that excess of air is between 20% and 150%.

7. The method of claim 1, further comprising the step of using a portion of the steam to recycle a portion of the flue gas at least into one of the afterburner chamber directly and a region that lies between the combustion chamber and the afterburner chamber.

8. The method of claim 7, wherein the proportion of recycled flue gas is between 5% and 50% of the total amount of flue gas.

9. The method of claim 7 wherein the flue gas is recycled with a temperature of at least 873° K.

10. The method of claim 7, wherein an amount of steam of between 4 and 40 g per $Nm^3$ of recycled flue gas is used for recycling the flue gas.

11. The method of claim 7, wherein a portion of the steam is used to bring one of nitrogen and other inert gases into the combustion boiler.

12. The method of claim 7, wherein nozzles are used for injecting the steam, said nozzles being disposed in one or several planes in the boiler wall in the region where the combustion gases leave the combustion chamber or in the region of the afterburner chamber.

13. The method of claim 7, wherein ultrasonic nozzles are used for injecting the steam.

14. The method of claim 7, wherein the flue gas is recycled through at least one duct, a steam jet being concentrically disposed in each duct.

15. The method of claim 7, wherein a proportion of recycled flue gas is 30% of the total amount of flue gas.

16. An apparatus for combusting solid matter in a combustion boiler, comprising at least one combustion chamber; at least one after burner chamber; and means for introducing steam by injection under an elevated pressure into the combustion boiler where the combustion gases leave the combustion chamber, to create turbulence adequate to thoroughly mix the combustion gasses, so that aside from the primary, no further combustion air enters into the combustion boiler.

* * * * *